US005903813A

United States Patent [19]

Moxson et al.

[11] Patent Number: 5,903,813

[45] Date of Patent: May 11, 1999

[54] METHOD OF FORMING THIN DENSE METAL SECTIONS FROM REACTIVE ALLOY POWDERS

[75] Inventors: Vladimir S. Moxson, Hudson; Aleksandr E. Shapiro, South Euclid, both of Ohio

[73] Assignee: Advanced Materials Products, Inc., Twinsburg, Ohio

[21] Appl. No.: 09/121,731

[22] Filed: Jul. 24, 1998

[51] Int. Cl.[6] ..... B22F 3/18

[52] U.S. Cl. ..... 419/28; 419/54; 419/55

[58] Field of Search ..... 419/28, 54, 55

[56] References Cited

U.S. PATENT DOCUMENTS

| | | | |
|---|---|---|---|
| 2,612,682 | 10/1952 | Burrack | 228/135 |
| 2,651,099 | 9/1953 | Roemer et al. | 29/17.5 |
| 2,835,022 | 5/1958 | Harris | 29/17.5 |
| 2,985,945 | 5/1961 | Nordheim et al. | 29/17.5 |
| 2,997,784 | 8/1961 | Petrovich et al. | 228/118 |
| 3,068,554 | 12/1962 | Wiedt, Jr. | 228/175 |
| 3,122,423 | 2/1964 | Hessler | 72/465 |
| 3,150,436 | 9/1964 | Bomberger | 29/17.6 |
| 3,164,884 | 1/1965 | Nobel et al. | 29/17.5 |
| 3,199,189 | 8/1965 | La Plante | 2228/190 |
| 3,237,298 | 3/1966 | Ma | 29/460 |
| 3,286,337 | 11/1966 | Sauve | 29/423 |
| 3,315,335 | 4/1967 | Witt | 72/363 |
| 3,352,008 | 11/1967 | Fairbanks | 29/599 |

(List continued on next page.)

OTHER PUBLICATIONS

"Deformation and Microstructure Development during Hot–Pack Rolling of a Near–Gamma Titanium Aluminide Alloy" S.L. Semiatin and V. Seetharaman, *Metallurgical and Materials Transactions,* vol.26A, Feb. 1995, pp. 371–381.

"Rolling of Titanium and its foil in Vacuum" Krupin et al., *Processing of the 3rd Int. Conf. On Titanium,* May 1976, Plenum Press.

"Producing Titanium Aluminide Foil from Plasma–Sprayed Preforms" S.C. Jha and J.A. Foster, *Journal of Metals,* Jul. 1993, pp. 57–59.

Metal Handbook, 9th edition, v.7, American Society for Metals, Materials Park, Ohio, 1984.

"Powder Metallurgy of Titanium Alloys" F.H. Froes and D. Eylon, *International Material Reviews,* 1990, vol.35, No. 3, pp. 162–182.

*Primary Examiner*—Daniel J. Jenkins

[57] ABSTRACT

A flat section with density not less than 25% from theoretical value is sintered from the powder of low ductile reactive alloy, welded by diffusion welding with cover foils made from ductile reactive metal that seal hermetically inner and surface pores, and assembled with two heat resistant sheets in the laminated package. Cover foils are made from metal that belongs to the same metal system as said sintered powder. The package is encapsulated in a capsule made from reactive alloy that belongs also to the same metal system as said sintered powder. An anti-adhesive release agent such as $Y_2O_3$, $A1_2O_3$, or $CaF_2$ is deposited on both sides of the laminated package and between cover foils and heat resistant sheets. A portion of metal powder such as Mn, Ti, Nb, Cr, or other metals, having a high affinity to oxygen, inserts into said capsule for absorbtion of oxygen during the heating and forming. After outgassing vacuum heating at 1100–1500° F. and sealing, the capsule with the laminate metal package inside undergoes hot rolling at the temperature range 1800–2450° F. with the reduction for 4–20% of the package thickness. This forming cycle is repeated until the desired thickness and density of said sintered section will be achieved. Thereafter, the formed sintered section is separated from said capsule and heat resistant sheets. The hot isostatic pressing can be used at any step of sintering and forming process for additional compaction and structure improvement of the thin foil or strip produced from low ductile reactive alloy.

8 Claims, 4 Drawing Sheets

U.S. PATENT DOCUMENTS

| | | | |
|---|---|---|---|
| 3,354,539 | 11/1967 | Cadden et al. | 29/423 |
| 3,375,695 | 4/1968 | Knapp | 72/366.2 |
| 3,481,013 | 12/1969 | Dannohl | 29/17.5 |
| 3,566,661 | 3/1971 | McCaffrty et al. | 72/220 |
| 3,615,907 | 10/1971 | Perry, Sr. et al. | 148/13.1 |
| 3,658,517 | 4/1972 | Davies et al. | 419/36 |
| 3,729,046 | 4/1973 | Kennedy et al. | 164/46 |
| 3,998,601 | 12/1976 | Yates et al. | 428/607 |
| 4,168,978 | 9/1979 | Keonig | 430/294 |
| 4,344,998 | 8/1982 | De Leeuw et al. | 428/212 |
| 4,357,395 | 11/1982 | Lifshin et al. | 428/607 |
| 4,616,393 | 10/1986 | Beauergard et al. | 29/423 |
| 4,917,858 | 4/1990 | Eylon et al. | 419/28 |
| 5,096,518 | 3/1992 | Fujikawa et al. | 156/89 |
| 5,121,535 | 6/1992 | Wittenauer et al. | 29/423 |
| 5,127,146 | 7/1992 | Wittenauer | 29/423 |
| 5,147,086 | 9/1992 | Fujikawa et al. | 228/243 |
| 5,222,146 | 6/1993 | Sukonnik et al. | 29/17.9 |
| 5,427,736 | 6/1995 | Ritter et al. | 419/28 |
| 5,445,787 | 8/1995 | Friedman et al. | 419/38 |
| 5,503,794 | 4/1996 | Ritter et al. | 419/28 |
| 5,701,575 | 12/1997 | Taguchi et al. | 419/28 |
| 5,768,679 | 6/1998 | Taguchi et al. | 428/548 |

A-A

METHOD OF FORMING THIN DENSE METAL SECTIONS FROM REACTIVE ALLOY POWDERS

FIELD OF THE INVENTION

The present invention relates to a method of forming thin metal sections such as metallic foil and sheet from low ductile reactive metals (initially in sintered powder form) and, more specifically, to a method which would prevent oxidation, cracking and other degradation during hot working of metal sections.

BACKGROUND OF THE INVENTION

Reactive alloys might be determined as alloys which exhibit an increase in chemical interaction with oxygen, nitrogen, carbon, etc. at elevated temperatures. Titanium aluminide, high strength titanium alloys, nickel aluminide, beryllium alloys, refractory metals, zirconium alloys, niobium, and many other pure metals represent the group of such reactive alloys. Thin sheets or foils of reactive metals such as titanium aluminides are used for manufacturing important structural elements designed for aircraft and space applications and the like, where high service temperature and high strength-to-weight components are required. However, this type of titanium alloy is difficult to process into foil or thin sheet elements using hot forming because their oxidation drastically increases at elevated temperatures. Also, the undesired diffusion of a gas into a metal surface produces a decrease in ductility.

The need for elevated temperatures during reactive metal processing has produced a number of prior techniques which eliminate oxidation atmospheres from the environment of the metal during high-temperature processing. For example, hot working in large vacuum chambers or in inert gas environments is a common technique. However, the costly manufacturing facilities, which are required in these processes, add additional costly expenses to the final product. In many applications, an oxide layer is removed from a metal section by machining or the like.

Most technologies known for manufacturing thin sections or foils of reactive metals incorporate special coatings, claddings or capsules that protect the reactive metal workpieces from oxidation and degradation during the hot forming process. For instance, in U.S. Pat. No. 3,164,884 to Noble et al., a method for the multiple hot rolling of sheets is disclosed in which cover plates and sidebars are assembled around inner reactive metal plates separated by a release agent. The sidebars are welded along their outer edges to the cover plates and to each other. The release (separating) agents are water mixtures of aluminum, chromium, or magnesium oxides. Additionally built-in vent holes permit gases that are formed in the package to escape during the hot rolling process.

In U.S. Pat. No. 5,121,535 to Wittenauer et al., a method of forming a reactive metal workpiece was created, which is protected from high-temperature oxidation during hot working by placing the workpiece in a malleable metal enclosure with a film of release agents interposed between major mating surfaces of the reactive metal section and the metal jacket. In a preferred embodiment, a metal section of a reactive metal is placed in a non-reactive metal frame. The reactive metal section and frame are then interposed between non-reactive metals of the top and bottom plates, with a release agent which exhibits viscous glass-like properties at high temperatures being disposed at the interfaces of the reactive metal sections. The release agent is provided preferably in shallow depressions or pockets in the non-reactive sections where the metal interfaces. The assembly, is then welded together near the perimeter so that the release agent is sealed in place between the sections.

The welded assembly may then be hot rolled under pressure to the desired gauge using conventional hot rolling machinery and procedures to form thin metal sections or foils. Other hot working techniques may be employed where suitable. As the assembly is hot rolled, the release agent flows to form a uniform interfacial film. Thus, accelerated oxidation during the high-temperature hot working of the reactive metal section is prevented using the present invention, by encapsulating the reactive metal section in a non-reactive metal jacket during hot working, with the major surfaces of the reactive metal core being separated from the encapsulant layers by a release agent.

Thereafter, the formed assembly or laminate is cooled, and the rolled assembly is sheared to remove the welded edges. The non-reactive metal sections are simply peeled from the reactive metal core by virtue of the presence of the brittle, non-cohesive release agent. Residual release agents can be removed from the finished reactive metal foil by a rinse or the like. In this manner, U.S. Pat. No. 5,121,535 provides a method by which bulk quantities of reactive metals such as refractory metals can be formed into thin metal sections such as foils or strips without the use of vacuum processing equipment and with the utilization of conventional hot working equipment such as hot rolling machinery.

All prior technologies of fabricating thin sheets or foils from reactive alloys have considerable drawbacks which make them undesirable in terms of sufficient protection from oxidation, cost, and production capacity, especially if the thin sections were produced initially from reactive alloy powders, which require additional hot working cycles for compacting. Developed porosity causes very rapid oxidation of the reactive alloy to a substantial depth, and capsules designed in known inventions do not protect the sintered section from rapid oxidation. A significant difference in structures and mechanical properties between sintered sections, produced from reactive powder metal, and the frame (capsule), produced from non-reactive wrought metal, result in nonuniform deformation and stress concentration of the laminate package during the hot rolling process. Cracks occurred in various places of the sintered section during the first cycles of hot rolling and do not allow it to maintain a stable manufacturing process. Therefore, it would be desirable to provide a costeffective method of producing thin metal sections from powder reactive alloys which reduces or eliminates destructive oxidation during high-temperature processing. The present invention achieves this goal by providing a method by which the powder of reactive metals can be formed into fully dense thin sections in a hot working process which can be carried out in an unmodified atmosphere at ambient pressure.

SUMMARY OF THE INVENTION

In accordance with the present invention, there is a method provided of hot forming thin metal strips or foils which are particularly suitable for sections that are initially produced by sintering reactive alloy powder. The present invention is extremely useful in the production of thin sections of low ductile alloys which oxidize rapidly at elevated temperatures. In addition to the metals set forth in the background of the invention, this invention is particularly useful in forming thin sections of pure titanium and titanium alloys such as titanium-aluminum-chromium-niobium. Many other pure metals and numerous alloys will also be suitable for metal forming by the method of the present invention.

The sintered section is produced near net shape of the final thin section, and should not have a density less than 25% of theoretical density of the initial reactive alloy. Another term would be that the initial thickness of the sintered section should be no less than 1.7 the desired final thickness of the thin section as a result of the hot forming process according to the present invention. These limitations of initial density and thickness are necessary because the sintered section having less density and thickness does not possess sufficient stiffness needed for subsequent rolling deformation, and does not allow the production of thin strip or foil without defects. Hot isostatic pressing (HIP) can be performed before or after sintering for increasing final density of sintered section.

The reactive alloy section is protected from high-temperature oxidation during hot working by placing it in a hot forgeable (or rollable) metal enclosure with a layer of a release agent interposed between major mating surfaces of the reactive alloy section and the metal capsule. A surface porosity of said sintered section is closed by two ductile foils, one on each side, made from the metal that contains a basic component of sintered alloy. These foils close the surface pores hermetically because they are joined to the sintered section by diffusion welding in the vacuum. This operation allows to the prevention of penetration of oxygen in the surface and especially in inner pores of the sintered section during hot working operations. The assembly of the sintered section and two cover foils is assembled in the package with two sheets, one on the each side, made from heat resistant high temperature ductile metal. The role of these sheets is to distribute the forming pressure during the hot rolling process.

In a preferred embodiment, a reactive alloy section is placed in a capsule made from a reactive alloy, also. Both reactive alloys (thin section and capsule) contain the same basic component. In other words, they belong to one alloy system. Although cover foils are made from the same basic components, they are more ductile and easily produced by means other than the proposed invention because they lack alloying additions than the sintered metal foil being produced. This provides uniform or almost uniform conditions of the hot deformation of the package. The release agent exhibits anti-adhesive properties between the interfaces of the thin section and capsule.

A portion of metal powder having a high affinity to oxygen is inserted into the capsule for the absorption of oxygen that is liberated from metals and diffused outside during the heating and forming. Such metal powders as manganese, titanium, niobium, or chromium can be used for this purpose. The capsule is then welded near the perimeter or other locations, and is exposed briefly to outgassing.

The welded capsule is then heated and hot rolled at the temperature range of 1800–2400° F. and in the deformation range of 4–20% of the capsule thickness per rolling pass. The forming cycle including preheating and rolling is repeated until a desirable thickness and density of reactive metal section is achieved. Hot isostatic pressing of the reactive metal section can be made additionally at any step of said forming cycle to obtain the required density and close cracks.

Thereafter, the formed capsule is cooled, welded edges are cut, and the laminated package is separated from the heat resistant sheets and thin reactive metal section. The residual release agent is removed from the surface of finished reactive metal section by a rinse or the like. Cover foil layers are removed from both sides of the reactive metal section by grinding, if necessary. In this manner, the present invention provides a method by which thin sections, strips, or foils can be formed from reactive alloy powders, without the use of vacuum processing equipment and with the utilization of conventional hot rolling equipment.

The above mentioned and subsequent objects, features and advantages of the present invention will become apparent from the following detailed description of preferred embodiments of the invention, when read in conjunction with the accompanying drawings.

BRIEF DESCRIPTION OF THE DRAWINGS

FIG. 1O is a longitudinal cross-section of the capsule of FIG. 7, illustrating a pocket with a powder for oxygen absorbtion, used in the present invention.

DETAILED DESCRIPTION OF THE PREFERRED EMBODIMENTS

Figure 1:
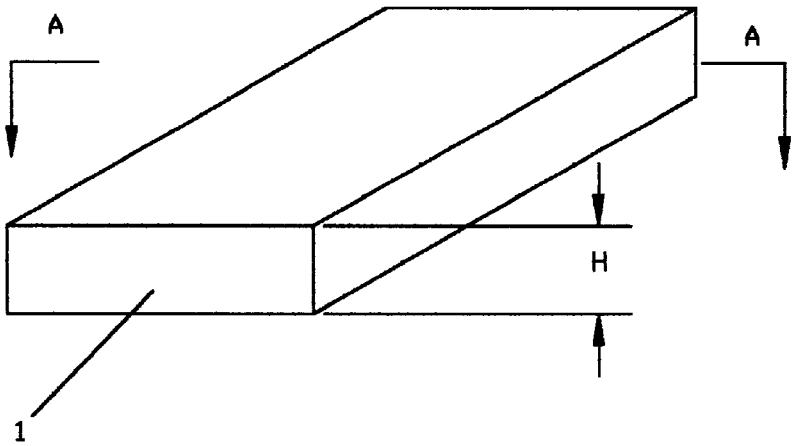
FIG. 1 is a plan view of a sintered reactive alloy section, H is the initial thickness of the sintered section.
Figure 3:
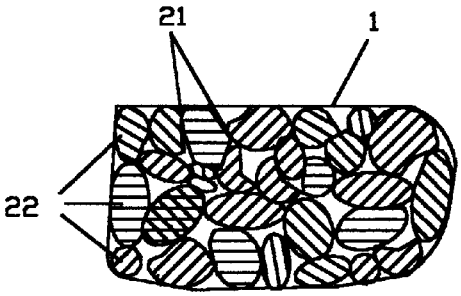
FIG. 3 is a cross-section of the sintered metal section of FIG. 1 that is showing a schematically effective sealing of sintering porosity and a formation of "bridges" between powder particles as result of overheating by sintering in accordance with the present invention.
Figure 3:
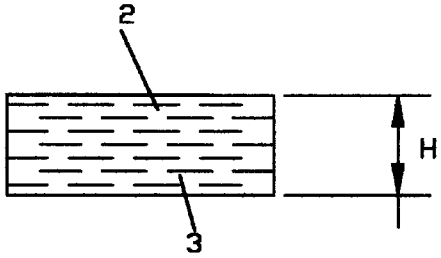
Figure 2:
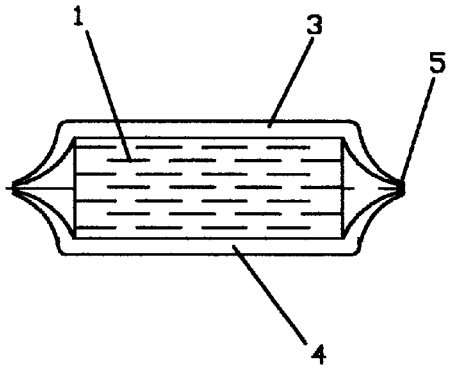
FIG. 2 is a cross-section of the reactive metal section of FIG. 1 that is showing 25–75% of porosity.

Referring to FIGS. 1 and 2, a sintered section produced from a reactive powder alloy is shown, which is to be formed into a thin metal section such as a foil or strip. Sintered section 1 is flat, having developed inner and surface porosity 2 as it is shown schematically in cross-section along the axis A—A. The γ-titanium aluminide alloys are particularly preferred in the present invention. These alloys are usually sintered in a vacuum at the temperature near the transus $\alpha \rightarrow \alpha+\gamma$ temperatures 2100–2300° F. According to this invention, the sintering is carried out at the temperature above the transus 2300–2500° F. This allows significantly sealing sintering porosity and decreasing an open surface of the sintered powder at the cost of the formation of melted "bridges" 21 between powder particles 22 (FIG. 3). A preferential range of density of the initial sintered section is 65–75% from the theoretical density depending on the powder form and size, and also on the temperature and time mode of the sintering process. A starting density of less than 25% would result in additional rolling cycles needed for the material compaction, or in increasing the level of rolling deformation in the first rolling cycles that causes cracks in both the laminate package and formed section as well. A preferential range of thickness of the initial sintered section H (FIG. 1) is from 4 to 6 times the final thickness of the desired thin section h (FIG. 14) that will be produced by the method of the present invention. This range of the initial thickness allows the production of fully dense strip or foil with fine grain structure that provide the best mechanical properties. The ratio 2:1 between initial H and final h thickness also provides a sufficient quality of formed material. But the ratio H:h is less than 1.7:1 and is not sufficient for producing fully dense thin strip or foil using the hot forming process.

HIP can be performed before or after sintering for increasing final density of sintered section. Values of the temperature and the pressure depend on the form and the required density of sintered section. Preferable temperature of the HIP is close to the sintering temperature but it can be less 200–300° C. of the sintering temperature.

Figure 4:
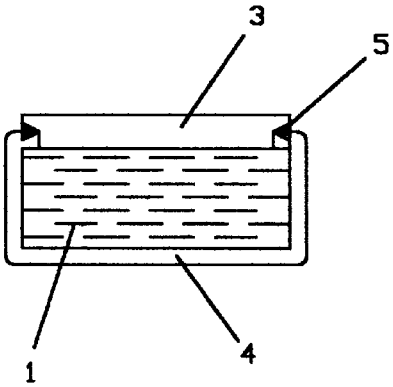
FIG. 4 is a cross-section of sintered section of FIG. 1 assembled with two foils according to the present invention.
Figure 5:
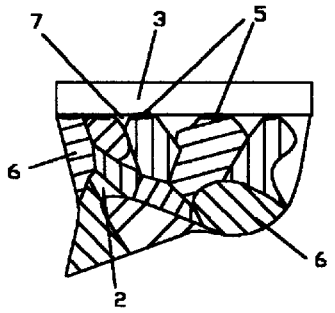
FIG. 5 is a magnified side view of the interface between a cover foil and sintered section that illustrates schematically the sealing of surface porosity by said cover foil before heating and forming deformation.

Referring to FIGS. 4 and 5, a surface porosity of initial sintered section 1 is closed by two foils 3 and 4, one on each side, made from the ductile metal that contains a basic component of sintered alloy. Preferably, for example, the initial sintered section 1 embodies a γ-titanium aluminide and said foils 3 and 4 embody pure titanium or Ti-6Al-4V alloy. These foils close the surface pores hermetically because they are joined to the sintered section by diffusion welding in the vacuum. As it is shown in FIG. 5, diffusion welding provides a strong metallic bond in all points of contact 5 of foil 3 with surface powder particles 6 of the sintered section. The edges of foils 3A and 4A are joined together by diffusion welding around the perimeter of the sintered section at the same time. These operations allow the prevention of penetration of oxygen in surface pores 7 and especially in inner pores 2 of the sintered section during hot working operations.

Figure 6:
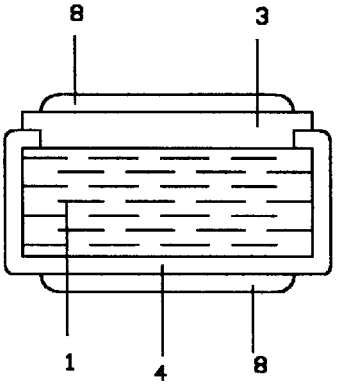
FIG. 6 is a cross-section of a reactive metal section of FIG. 3 with deposited layers of the release agent.
Figure 7:
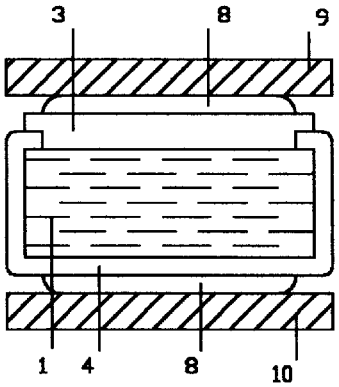
FIG. 7 is a cross-section of the package including the section of FIG. 5 assembled with two heat resistant sheets used in the present invention.
Figure 14:
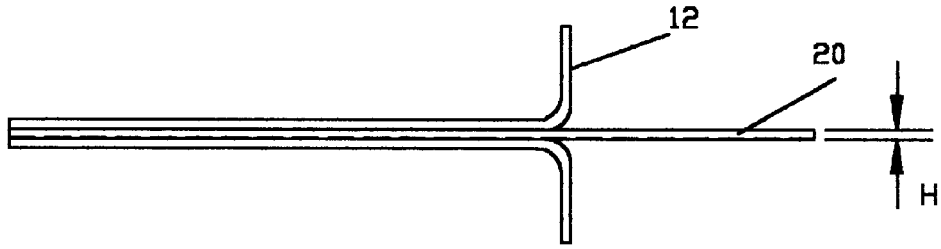
FIG. 14 is a longitudinal view illustrating removal of the capsule and heat resistant sheets from the finally formed reactive alloy thin section with the release agent not shown for simplicity

In accordance with the invention, the initial sintered section 1 and two cover foils 3 and 4 are assembled in the package with two sheets 9 and 10, one on the each side, made from heat resistant high temperature ductility metal, as can be seen in FIGS. 6 and 7. Preferably, if the starting sintered section 1 embodies a γ-titanium aluminide, the heat resistant ductile sheets 9 and 10 embody molybdenum, Ti-6Al-4V, or Ti-5Al-2V alloys. The preferential thickness of these sheets is ⅛ or 1/10 of the initial section thickness H but not less than 0.03". The role of these sheets is to distribute the rolling pressure during the hot rolling process. An absence of sheets 9 and 10 result in the cracking of the brittle sintered section. Two layers of release agent 8 are deposited on both sides of the initial section, as indicated in FIG. 6, before its assembly with two heat resistant sheets 9 and 10. The release agent 8 will permit the removal of the final formed section 20 from the finished article (FIG. 14).

The most preferred release agents for use in the present invention are calcium fluoride, yttrium oxide, and aluminum oxide, with yttrium oxide being the most preferred material for this purpose. To deposit layer 8, the release agent may be prepared as methyl or ethyl alcohol mixture that is sprayed onto the appropriate metal surface. The preferred method of depositing the release agent is by painting, using the preliminary prepared mixture of release agent powder of 80–85% and an acrylic resin solution in acetone 10–15%. Drying is the final operation after depositing the release agent.

Figure 8:
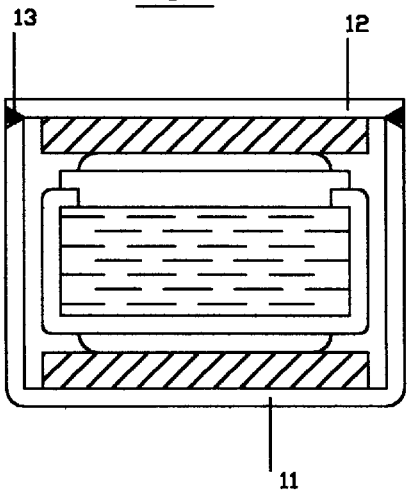
FIG. 8 is a cross-section of the welded capsule (stamped box) with the package of FIG. 6 inside.
Figure 9:
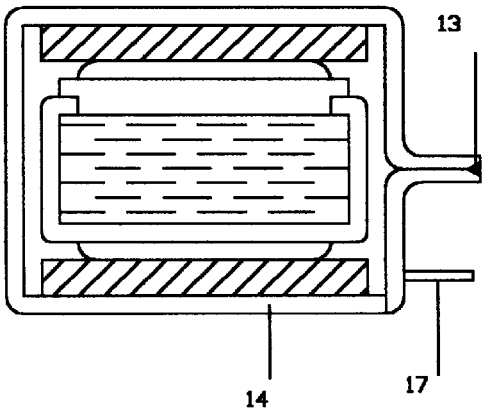
FIG. 9 is a cross-section of the welded capsule (bent box) with the package of FIG. 6 inside.

The laminate package shown in FIG. 7 comprising a reactive alloy section 1 is placed in a capsule 11 made from a reactive alloy, also. Both reactive alloys (forming section and capsule) contain the same basic component. In other words, they belong to one alloy system. This provides uniform, or almost uniform conditions of hot deformation of the package. Preferably, for example, the initial sintered section 1 embodies a γ-titanium aluminide and the capsule 11 with cover 12 embodies Ti-6Al-4V or Ti-5Al-2V alloys. The release agent layer 8 exhibits anti-adhesive properties between the interfaces of the laminate package and capsule. Both preferred designs of the capsule are shown in FIGS. 8 and 9: a stamped box 11 with welded cover 12, and a bent box 14 with three side welded edges 13. An advantage of the second design is that its fabrication is less costly and simpler (FIG. 9). The first design (FIG. 8) possesses stiffness because of the box 11.

Figure 10:
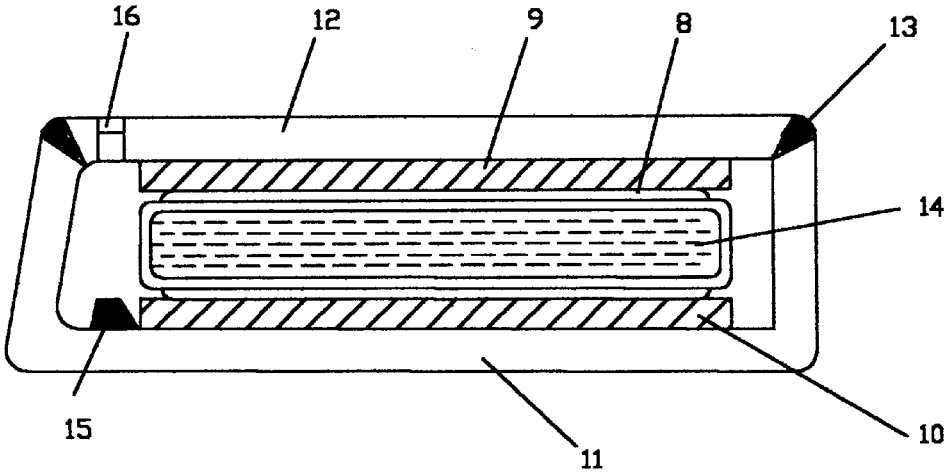
Figure 11:
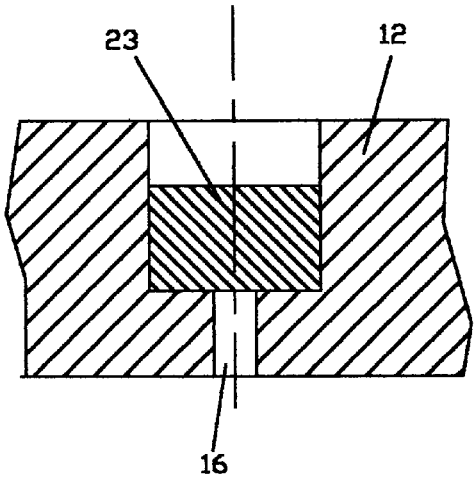
FIG. 11 is a cross-section of the exhaust hole with the shim of brazing alloy in the initial position and during the vacuum outgassing process.
Figure 12:
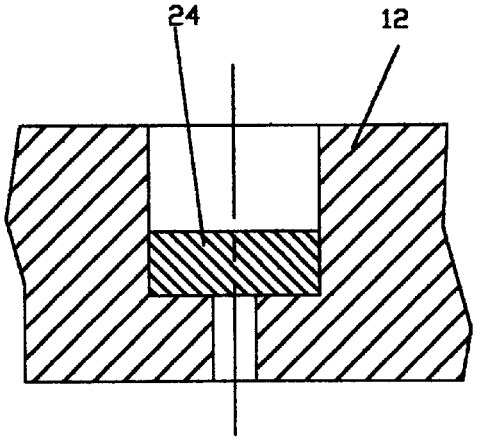
FIG. 12 is a cross-section of the exhaust hole with the "plug" of brazing alloy after its melting and solidification inside of the exhaust hole.

In accordance with the invention, a portion of metal powder 15 having high affinity to oxygen is inserted into the capsule (FIG. 10) for the absorption of oxygen that is liberated from the surfaces of all components of the laminated package (sintered and wrought metals, release agent, and weldments) and oxygen that is diffused outside during the heating and forming. Preferred metal powders such as manganese, titanium, niobium, or chromium can be used for this purpose; the first two particularly. The capsule is then welded near the perimeter, and is exposed briefly to outgas. The preferred outgas procedure is carried out in two steps. First, the welded capsule with the whole package inside is placed into a vacuum furnace for heating at 1100–1500° F., for 30–60 minutes. The binder of the release agent and most surface contaminants are burned up and removed from the capsule through the exhaust hole 16 in the capsule wall 12 (FIG. 10) or through the exhaust pipe 17 in the capsule (FIG. 9). Secondly, the exhaust hole is sealed by brazing during this heating process using a shim of silver-copper-titanium (or eutectic silver-copper) brazing alloy 23 that was put in the exhaust hole preliminary (FIG. 11). This shim 23 does not slow down outgassing when it is solid (during the temperature rise) or melt. But it seals the hole 16 reliably after its solidification which occurs during the cooling of said capsule. The brazed "plug" 24 is shown in FIG. 12. If an exhaust pipe is used, the air is pumped out from the capsule at room temperature with a duration of 15 minutes with the subsequent sealing of the exhaust hole or pipe using arc welding.

Figure 13:
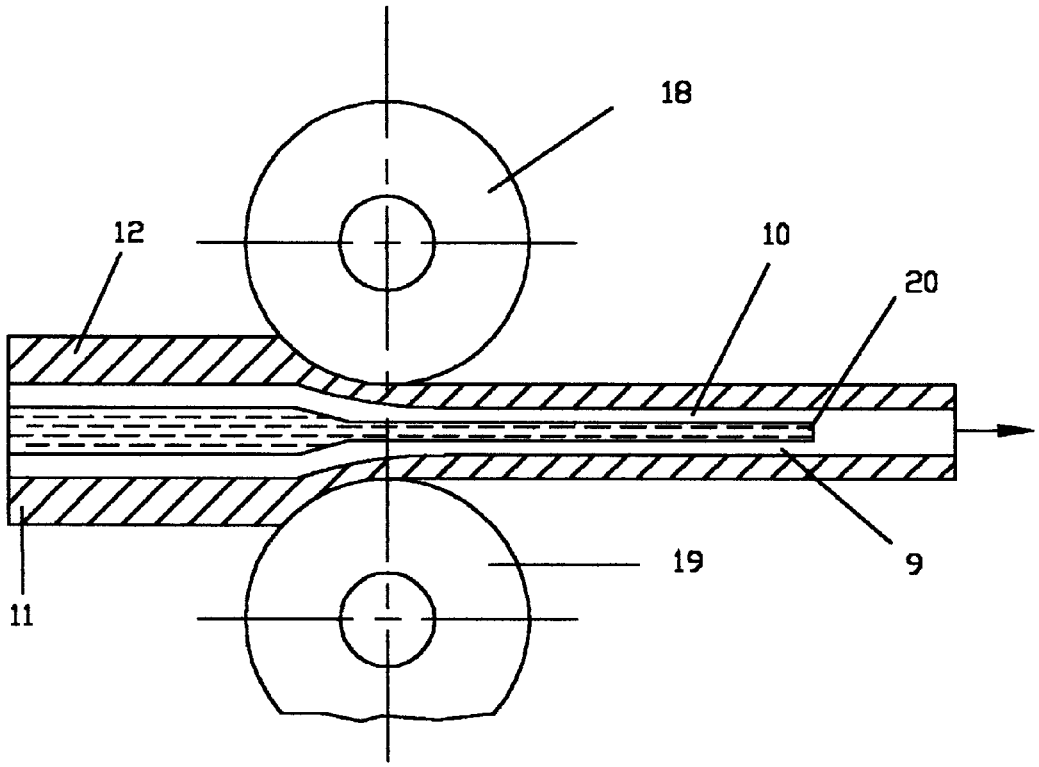
FIG. 13 is a schematic illustration of the whole laminate package of FIG. 8 undergoing hot rolling after preheating.

The welded capsule is then heated and hot rolled by two rolls 18 and 19 at the temperature range 1800–2450° F. and with 4–20% reducing of the capsule 11 thickness per rolling pass, as it is schematically illustrated in FIG. 13. The forming cycle including preheating and rolling is repeated until the desirable thickness and density of reactive metal section is achieved. Preferred rolling parameters for the production of thin section from pure titanium powder are 1800–2000° F. preheating and reducing of the thickness for 10–12% per first 3–4 rolling passes, then 15–20% per pass.

For production of thin sections from titanium aluminides, preferred parameters are: preheating at 2200–2450° F. and reducing of the capsule thickness for 4–5% per first three passes, and then 8–10% per pass.

HIP of the reactive metal section can be made additionally at any step of said forming cycle to obtain the required density and close cracks. HIP regime depends on the required density and the surface condition of the section produced. HIP can be performed either for formed sintered section or for outgassed and sealed capsule prior to forming.

Thereafter, the formed capsule is cooled, welded edges are cut, laminated package is separated to heat resistant sheets 9 and 10 and thin reactive metal section 20 (FIG. 14). Residual release agent is removed from the surface of finished reactive metal section by a rinse or by a metal brush. Cover foil layers are removed from both sides of reactive metal section using grinding if necessary. In this manner, the present invention provides a method by which thin sections, strips, or foils can be formed from reactive alloy powders, without the use the vacuum processing equipment and with the utilization of conventional hot rolling equipment.

We claim:

1. A method for processing thin and fully dense strips or foil sections from low ductility reactive alloys comprises the following steps:

(a) forming and sintering the reactive powder alloy in an initial section with the density no less than 25% from the theoretical density of said reactive alloy and with the thickness no less than 1.7 of a final thickness of fully dense thin section will be produced by hot forming;

(b) assembling said sintered section with two foils, one on each side, made from the alloy that contains at least a basic component of sintered powder alloy, but has a higher ductility than sintered powder alloy in near fully dense conditions in the temperature range from room temperature up to forming temperature;

(c) diffusion welding of said foils to said sintered section providing vacuum encapsulation;

(d) deposition of a release agent, which is chemically inert with respect to said sintered alloy and foils, on both sides of the said assembly;

(e) assembling said sintered section and foils in the package with two sheets, one on each side, made a from heat resistant, high temperature ductile metal;

(f) encapsulating the whole said laminate package in a capsule made from a reactive alloy that belongs to the metal systems based on the main component of said sintered powder alloy;

(g) inserting a portion of metal powder such as manganese, titanium, niobium, chromium, or other metals, having a high affinity to oxygen, into said capsule for absorption of oxygen during the heating and forming;

(h) outgassing vacuum heating at the temperature range 1100–1500° F. and sealing of said capsule;

(i) forming by hot rolling said capsule with said laminate metal package at the temperature range of 1800–2450° F. with reducing for of 4–20% of the package thickness per pass;

(j) repetition of said forming cycle until desired thickness and density of said sintered section will be achieved;

(k) separating said formed sintered section from said capsule and heat resistant sheets.

2. The method according to claim 1 wherein the hot isostatic pressing is used additionally at any step of the process of sintering and forming of said section made from reactive alloy.

3. The method according to claim 1 wherein the whole laminate package contains more than one sintered reactive alloy section assembled with foils and heat resistant sheets.

4. The method according to claim 1 wherein the diffusion welding of foils to the reactive powder alloy section is carried out simultaneously with the sintering of said section.

5. The method according to claim 1 wherein the foil layers are removed from both sides of finally formed thin section of reactive alloy using grinding or any type of other machining.

6. The method according to claim 1 wherein the sintered formed section is produced from titanium aluminide alloy, cover foils and capsule made from titanium or titanium-aluminum-vanadium alloy, and heat resistant sheets made from molybdenum.

7. The method according to claim 1 wherein the sintering of the reactive powder alloy in an initial section is carried out at the temperature above the temperature of hot rolling.

8. The method according to claim 1 wherein sealing of the capsule with the whole laminated package is produced by brazing of the exhaust hole simultaneously with vacuum outgassing.

* * * * *